United States Patent [19]

Paist et al.

[11] 4,332,054

[45] Jun. 1, 1982

[54] BLOCK AND TACKLE WINDOW SASH BALANCE AND INSTALLATION METHOD

[75] Inventors: H. Palmer Paist, Broomall; Barry M. Jones, Berwyn, both of Pa.

[73] Assignee: Quaker City Manufacturing Company, Sharon Hill, Pa.

[21] Appl. No.: 157,858

[22] Filed: Jun. 9, 1980

[51] Int. Cl.[3] ..... E05D 13/12

[52] U.S. Cl. ..... 16/197

[58] Field of Search ..... 16/197, 220, 193, 194, 16/200, 202, 210; 49/445, 456

[56] References Cited

U.S. PATENT DOCUMENTS

| | | | |
|---|---|---|---|
| 3,869,754 | 3/1975 | Foster | 16/197 |
| 4,089,085 | 5/1978 | Fitzgibbon | 16/197 |

*Primary Examiner*—Doris L. Troutman

*Attorney, Agent, or Firm*—Synnestvedt & Lechner

[57] ABSTRACT

An improved block and tackle type sash balance that can be installed in single and double-hung windows by a single workman without the necessity of removing the window sashes from the window frame and reassembling the window unit.

8 Claims, 11 Drawing Figures

RETRACTED POSITION
BRIDGING POSITION
EXTENDED POSITION
Sw
RF

BLOCK AND TACKLE WINDOW SASH BALANCE AND INSTALLATION METHOD

Heretofore it has been generally regarded—particularly among "do-it-yourselfers"—as a rather difficult task to install window balance sashes in older type windows or to replace broken balance sashes in existing single and double-hung windows; to do so calls for the services of a professional workman, and where large size windows are involved, the operation usually requires the services of a workman and a helper. Such installations or replacements require disassembling substantially the entire window unit, removing the window sashes from the window frame and reassembling the window unit. Where the window sashes are mounted in metal or plastic weatherstripping window channels, the manipulative operations are especially cumbersome if bending of the window channels is to be avoided. In such cases, it is first necessary to remove the inside or trim stops from the sides and top of the window, remove the sashes and the old weatherstripping channels from the window frame and re-install a sub-assembly of sash channels and sash balance as delivered from the factory in the stripped frame. This job, particularly where block and tackle type sash balances are involved, is one that usually cannot be accomplished by persons with routine carpentry skills, and therefore, to effect such repairs or conversions, it is necessary to employ professional carpenters.

THE OBJECT OF THE INVENTION

It is an object of this invention to provide an improved block and tackle type of sash balance that can be installed in single and double-hung windows by a single workman and without the need of resorting to skilled professional carpenters or mechanics. The improved sash balance can, of course, be installed by professionals, and can also be employed to facilitate off-site sub-assembly operations.

Certain of the objectives and advantages of this invention are obtained in a window sash balance of the type comprising an elongated tubular housing frame, a helical spring, a block and tackle assembly, and a foot member adapted for engagement with the under edge of a window sash when aligned in a bridging position at the end of the balance housing frame; and in which said spring and said block and tackle assembly are positioned within wall portions of the balance housing frame; one end of the spring being anchored relative to the housing frame; one pulley being anchored relative to the housing frame; one pulley block is anchored to the housing frame at a point separated from the spring anchor point; the other pulley block is connected to the unanchored spring end; the tackle cord is secured to one of the pulley blocks and is sequentially trained over the pulley block sheaves terminating in engagement with the foot member which bridges the end of the channel adjacent the frame anchored pulley block; the length of the tackle cord being such that the foot member will be held against the housing frame end by biasing action of the spring when the foot member is aligned in a bridging position, the improvement being one in which a lanyard is secured to the foot member, said lanyard being of a length that it will extend outwardly from the end of the housing frame when the foot member has been disengaged from its bridging position and is retracted within the housing frame.

DESCRIPTION OF PREFERRED EMBODIMENT

Figures 1, 1A, 2, 3, 4, 4A:
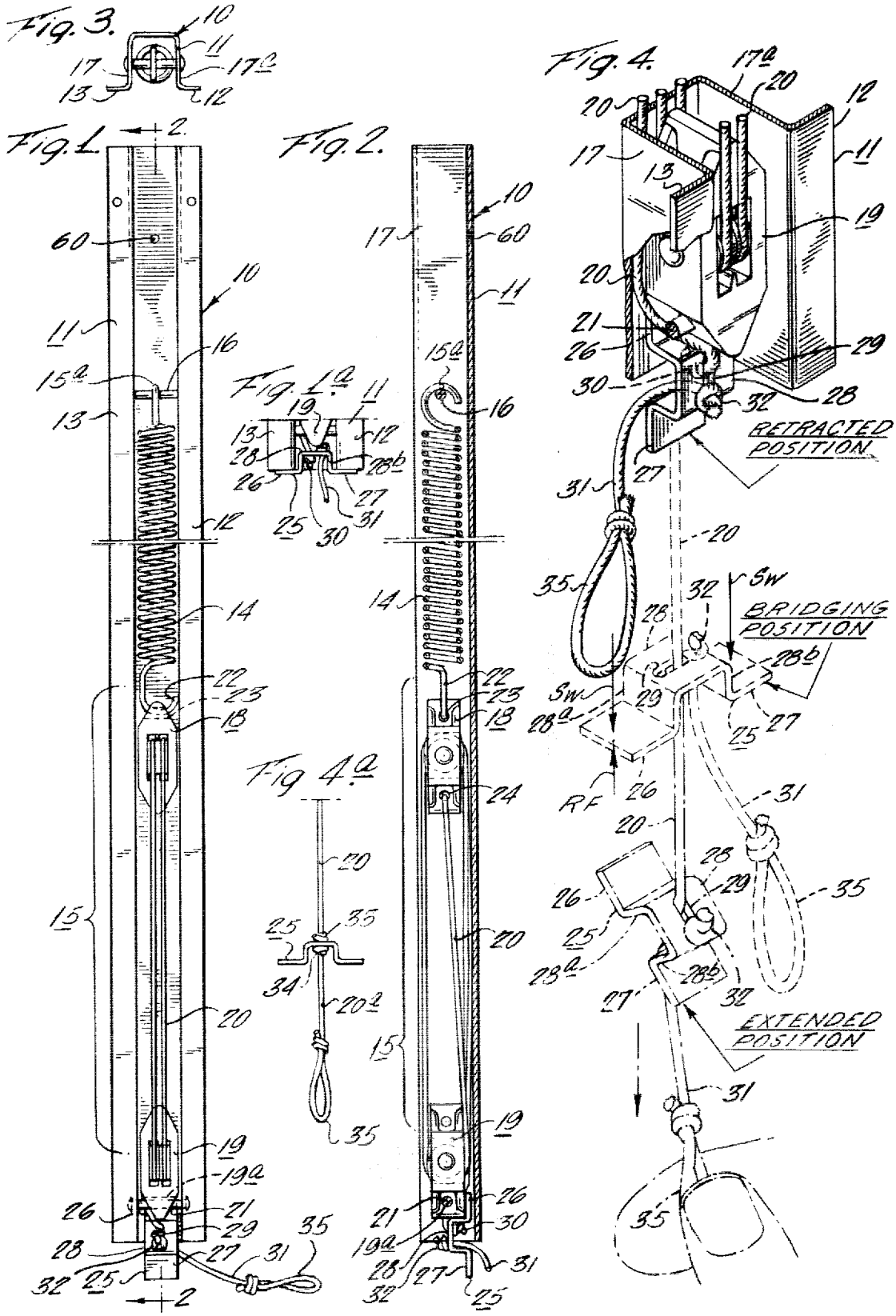
FIG. 1 is a front elevational view of the improved block and tackle type sash balance of this invention.
FIG. 1*a* is a front elevation of the lower end of the sash balance of FIG. 1 showing the foot member in its bridging position.
FIG. 2 is a sectional view of the sash balance of FIG. 1 along section line 2—2.
FIG. 3 is a top view of the sash balance of FIG. 1.
FIG. 4 is a perspective view, partly in section, of the lower portion of the sash balance of FIG. 1 and in which the broken lines illustrate changes in positioning of the foot member when the sash balance is employed in accordance with this invention.
FIG. 4*a* is an alternative arrangement of the lanyard shown in FIG. 1.

In the preferred embodiment of this invention, a block and tackle type sash balance 10 is shown in FIGS. 1 and 2 and except for the lanyard extension and the positioning of the foot member in FIGS. 1 and 2, a conventional sash balance is illustrated. When such balances are delivered from the factory, either as the balance alone or as a component of a combined sash balance and weather stripping channel assembly, the foot member is positioned as in FIG. 1*a*.

The sash balance includes an elongated tubular housing member 11 of plastic or thin metal. It can be of any cross-sectional configuration that will enable a ploughed window sash to be slidably mounted thereon and which can house the spring biased block and tackle assembly. The preferred cross-sectional configuration being of a generally "U"-shape as can be seen in FIG. 3, having flanges 12, 13 projecting outwardly from the upper portions of the sidewalls or legs 17, 17*a* of the "U" channel respectively.

A counterbalancing mechanism is positioned and housed within the elongated housing frame channel. In the simplest arrangement, the counterbalance can be provided by a spring element alone, however, in the preferred embodiment shown in FIGS. 1–3 the combination of a helical spring 14 and a block and tackle assembly 15 function as the counterbalance, as such arrangement readily permits making a wide variety of tensioning adjustements to accomdate sashes of differing weight.

As can be seen in FIGS. 1–3, one hook end 15*a* of the spring is anchored relative to the frame housing channel in an upper portion thereof by a pin member 16 that extends between and is fixedly mounted relative to the sidewalls 17, 17*a* of the housing member.

The block and tackle assembly includes a pair of pulley blocks 18 and 19 and a tackle cord 20. The number of pulley wheels or sheaves employed and the tackle cord threading can be varied in a known manner to provide the desired mechanical advantage. However, in the illustrated emobidment, each block has two separate pulley wheels arranged to provide 4:1 mechanical advantage. Pulley block 19 is anchored relative to the housing frame by means of pin 21 which passes through eye 19*a* of the block and extends between and is secured to the side walls 17, 17*a* of the housing channel in a lower portion thereof. Pulley block 18 is connected to the unanchored end of spring 20 by passing the spring lead or hook end 22 through eye 23 of the block. The tackle cord 20 is secured to eye 24 of block 18 and sequentially trained over each of the sheaves of blocks 19 and 18 and terminates at foot member 25.

In the sash balance as illustrated in the drawings, the foot member when supporting the weight of a window sash (Sw) is positioned so as to bridge the side walls 17, 17*a* of the housing frame 11 at the lower end thereof. The foot member when so positioned has a pair of flanges 26, 27 that extend beyond the wall 17, 17*a* of the housing frame and that provide means to support the window sash when the balance unit is installed in a window frame assembly as will be described hereinafter.

Foot member 25 need not be limited to the precise configuration shown in the drawings but it should be so dimensioned in width and thickness that it can be retracted into the channel of the housing frame when aligned with the channel axis as shown in FIGS. 1, 2 and 4 (solid line) and in length so that it can bridge and extend beyond the channel sidewalls when positioned as in FIG. 1*a*. The preferred foot member as illustrated has a stepped central plateau portion 28, of a width that enable it to be received and centered in the housing frame channel, a pair of depending sidewalls 28*a*, 28*b* at the bottom of which flanges 26, 27 project outwardly beyond the channel sidewalls 17, 17*a*; the stepped plateau facilitates centering of the foot member in its conventional positioning shown in FIG. 1*a*.

The central plateau 28 is provided with a slot 29 and the tackle cord 20 passes through the slot and is knotted 30 or otherwise fixed relative to the foot member so that the reaction forces (RF) of the spring 14 will be exerted against the foot member 25 to draw it toward the housing frame end. The length of the tackle cord 20 from eye 24 of block 18 to engagement know 30 (or other stopping means that cannot pass through slot 29) at the foot member 25 is such that the foot member will be held against the end of the frame housing by biasing action of the spring 14 when the foot member is aligned in its bridging position as can best be seen in FIG. 1*a*.

Figure 8:
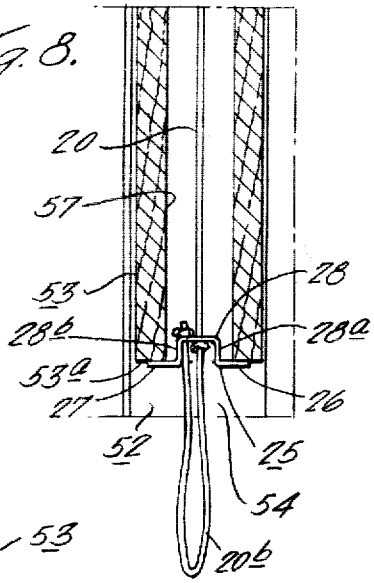
FIG. 8 is a sectional view of the window frame assembly of FIG. 7 taken along section line 8—8 and also shows still another alternative lanyard arrangement.
Figure 9:
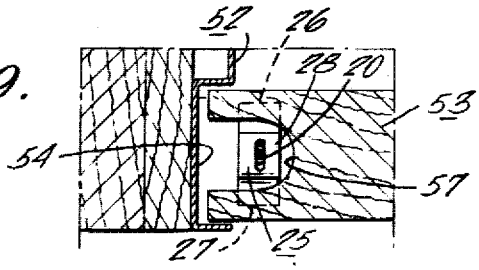
FIG. 9 is a vertical section of the window frame assembly of FIG. 8 taken along section line 9—9.

To enable certain of the objectives of the invention to be accomplished a lanyard is attached to the foot member to facilitate manipulating and repositioning of the foot member. The lanyard can be, as shown in FIGS. 1–4, a separate cord element 31 that passes through slot 29 and is knotted 32 so that the knot will not pass through slot 29 but will bear against the top of the foot member and cause it to disengage and tilt when a pulling force is applied to the lanyard that opposes the biasing action of spring 14. Alternatively, as shown in FIG. 4*a* (and still differently in FIG. 8), the lanyard can be an extension 20*a* (or 20*b*) of tackle cord 20 that is secured to the foot member—most expeditiously by forming knots in the tackle cord above 33 and below 34 the central plateau 28 so as to enable the lanyard and tackle cord to exert downward and upward force respectively on the foot member. It will be appreciated that other methods of securing the tackle cord to the foot member can be employed provided bidirectional forces can be applied to the foot member. The lanyard is preferably provided with means—such as the loop 35—to enable manual manipulation of the foot member as shown in FIG. 4. The lanyard need not be limited to a cord-like element but can be a chain or other extension device that can be secured to the foot member to enable it to be manipulated. The lanyard 31 should be of sufficient length to project outwardly from the end of the frame for an appreciable distance when the foot member has been disengaged from the bridging position as in FIG. 1*a* and retracted within the frame housing as shown in FIGS. 1 and 2 and in the solid line "Retracted Position" in FIG. 4. Pulley block 19 serves as a stop to arrest retraction of the foot member when it has been displaced from its bridging position and aligned for retraction into the frame housing; if desired, other suitable retraction arresting means can be provided.

FIGS. 4 to 9 serve to illustrate a preferred method of installing the sash balance in accordance with this invention.

Figure 5:
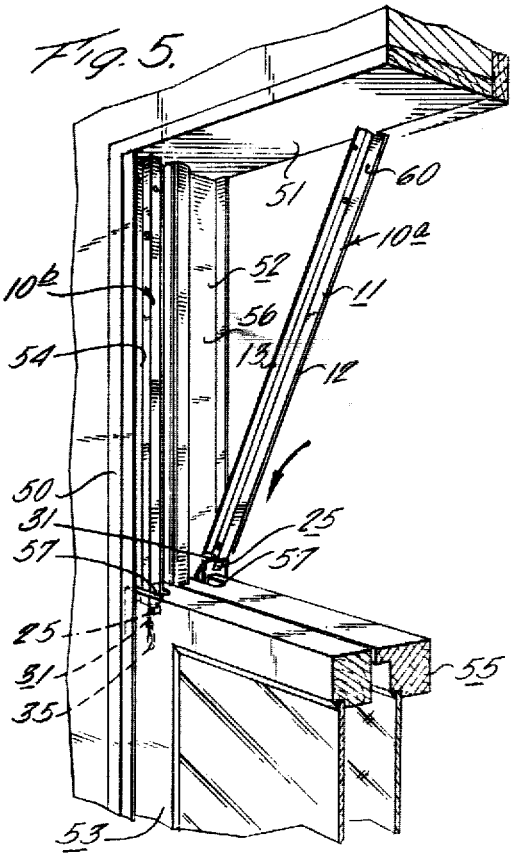
FIG. 5 is a perspective view of a vertical section of portion of a double-hung window illustrating the installation of the sash balance of FIG. 1 and in which both sashes are shown in the lowered or bottom position in the frame assembly.
Figure 6:
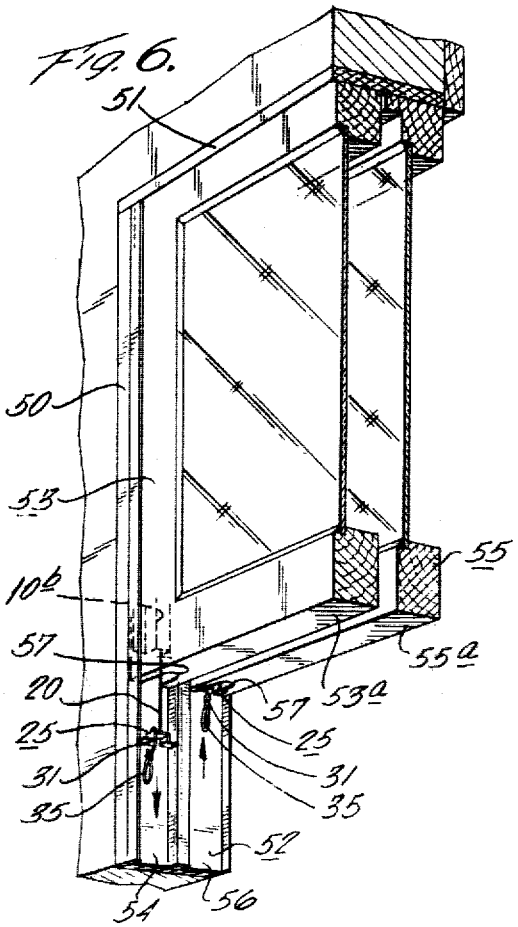
FIG. 6 is a perspective view of a vertical section of a portion of a double-hung window and with both sashes shown in their upper or raised position in the window frame.
Figure 7:
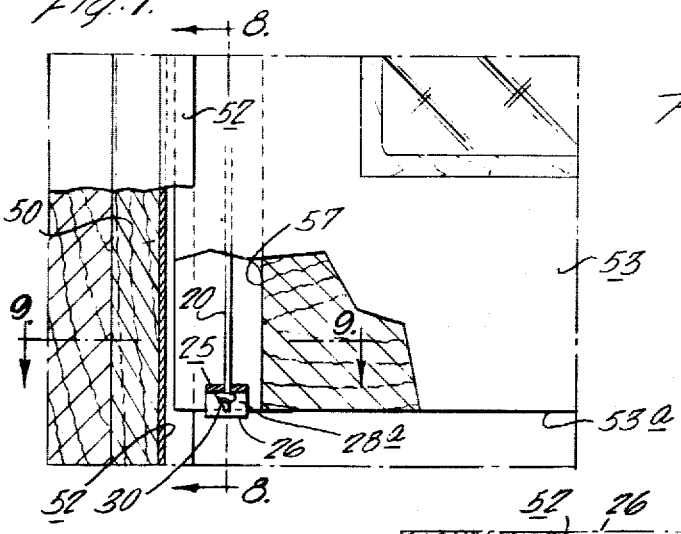
FIG. 7 is a front elevation view of a window frame assembly showing the sash track and a lower portion of the upper window sash (parts of which have been broken away) and illustrates the relative positioning of the components of the window assembly embodying features of the present invention when the window sash is in a lower portion of the sash track.

In FIGS. 5 and 6, a double-hung window frame is illustrated. Lefthand jamb 50, a head plate 51 (not shown), a sill and a right-hand jamb (not shown), frame the window opening. A double track weatherstrip channel element 52—for example, one of the structure shown in U.S. Pat. No. 2,885,744—is mounted on the jamb. Bottom sash 53 rides in sash track 54 and upper sash 55 rides in sash track 56. The sides or vertical sash members of the upper and lower sashes are ploughed 57 along the full length of the side members; the configuration and dimensions of the ploughed channel being such that the sash balance frame housing can nest in the ploughing and permit the sash to slide thereover.

To install the sash balance (or to replace a broken sash balance that has already been removed from the window assembly), one preferably starts with the window sashes in their bottom position in the sash tracks as shown in FIG. 5 and with the foot member 25 of the sash balance in the "Retracted Position" as in FIGS. 1, 2 and 4. The lower end of the sash balance from which lanyard 31 projects is inserted in the upper portion of the plouged channel and with flanges 12 and 13 of the housing frame facing the sash track. Because the geometry of modular window units has been standardized in the industry, the distance from the head plate 51 to the tops of the window sashes (when the sashes are in their bottom position in their respective sash tracks) will be slightly shorter than the overall length of the sash balance that is adapted to be used with a sash of any given size, and therefore, as shown in FIG. 5 it is necessary to tilt the sash balance 10*a* away from the sash track in order to get the lower end of the balance and lanyard started into the ploughed sash channel. The sash balance 10*a* is then pivoted on its lower end into the sash track 56 while continuing to feed the sash balance into ploughed channel until it can be swung into an upright position aligned with its sash track, i.e., the position of sash balance 10*b* in sash track 54 with its upper end abutting head plate 51 as shown in FIG. 5. A single screw, nail or like fastener is then driven into the jamb through an opening 60 provided in the frame housing near the upper end thereof to secure the upper end of the sash balance to its sash track. The lower end of the balance is not secured to the sash track so that it can be free to move to accomodate irregularities in sash alignment, swelling, etc. To complete the installation for the upper sash, the same operations are repeated for the opposite or right hand sash track (not shown) of upper sash 55 and for the lower sash 53 on the left and right hand (not shown) sash tracks.

The window sashes are then raised to their upper most position as shown in FIG. 6. Because of standardized modular window sash and conventional sash balance geometry, the lower end of the sash balance 10*b* will be within the ploughed channel—i.e., above the bottom edge 55*a* of the lower transverse sash member and the lanyard will extend from the ploughed channel below the lower sash edge (as can be seen in FIG. 6 where lanyard 31 a extends below the bottom edge 55*a* of upper transverse sash member of the upper sash 55).

By means of the lanyard, the foot member can be pulled from its "retracted position" within the housing frame, to its "Extended position" (FIG. 4) below the bottom sash edge. The foot member is then permitted to be repositioned by the biasing spring action so that it bridges the ploughed channel 57 at the bottom sash edge 53*a* (as in FIG. 8) and the weight of sash (Sw) is counterbalance by the spring and pulley arrangement. These operations are then repeated for the right hand sash track of the lower sash and the left and right hand sash tracks of the upper sash to complete the installation. After testing for alignment and slidability, the lanyards can be cut so that they will not be visible when the window sashes are in raised positions in the sash track. These operations are of such simplicity that a single non-professional workman can install or replace sash balances in single or double-hung windows having ploughed channels.

An alternative way of installing a block and tackle window sash balance in a single or double-hung window unit in which the vertical sash members are ploughed involves starting with the sash in its uppermost position in its sash track of the window frame or of a weatherstripping member and with the foot member of the sash balance retracted within the housing frame and with the lanyard extending outwardly from said frame as in FIG. 1 and in the solid line drawing of FIG. 4; the end of the sash balance opposite that from which the lanyard extends is inserted into the ploughed channel for the full length of the sash balance, lowering the sash and balance in the sash track, pushing or raising the sash balance from its position within the ploughed sash channel preferably without completely displacing the balance from the ploughed channel; raising the sash balance so that its upper end is in the desired position relative to the top of the sash track, securing the balance to the sash track; raising the sash to its upper position so that the balance extends into the ploughed sash channel and so that the lanyard extends below the bottom lower edge of the horizontal sash member; by means of the lanyard, pulling the foot member from within the housing frame to a position below the bottom sash edge; repositioning the foot member so that it bridges the ploughed channel at the bottom edge of the horizontal sash and is maintained in the bridging position by the biasing action of the spring.

In standard window frames, the sash track for the upper sash is longer than the sash track for the lower sash; therefore, to prevent the upper sash from riding off the sash balance when lowered to its down position, it is frequently desirable top provide stopping means near the bottom of the sash track for the upper sash to arrest downward movement of the sash.

We claim:

1. In a window sash balance comprising an elongated tubular housing frame, a helical spring, a block and tackle assembly, and a foot member adapted for engagement with the under edge of a window sash when aligned in a bridging position at the lower end of the frame housing; and in which said spring and said block and tackle assembly are positioned within wall portions of the housing frame; one end of the spring is anchored relative to the housing frame; one pulley block is anchored to the housing frame at a point separated from the spring anchor point; the other pulley block is connected to the unanchored spring end; the tackle cord is secured to one of the pulley blocks and is sequentially trained over the pulley block sheaves terminating in engagement with the foot member which bridges the lower end of the housing frame; the length of the tackle cord being such that the foot member will be held against the lower end of the housing frame end by biasing action of the spring when the foot member is aligned in a bridging position relative to the walls of the frame, the improvement characterized in that a lanyard is secured to the foot member, said lanyard being of a length that it will extend outwardly from the end of the housing frame when the foot member has been disengaged from its bridging position and is retracted within the housing frame.

2. A window sash balance according to claim 1 wherein the tubular housing frame is a channel member having generally a "U"-shaped cross-section.

3. A window sash balance according to claim 1 wherein the lanyard is an extention of the tackle cord.

4. A sash balance according to any of claims 1, 2 or 3 wherein the foot member is longer in one dimension than the cross-sectional dimension of the lower end of the housing frame so as to provide a pair of outwardly extending sash-supporting flanges when the foot member is in its bridging position, and having a thickness and width that will permit retraction of the foot member into the housing frame when it is disengaged from its bridging position.

5. A sash balance according to claim 4 wherein the foot member is an inverted "U"-shaped bracket having a pair of flanges extending outwardly from generally parallel upwardly extending side walls and a central portion offset from the flanges interconnecting the side walls and wherein the tackle cord engages said central portion.

6. A sash balance according to claim 5 wherein the offset central portion of the foot member can be retracted into engagement with the end of the housing frame when the foot member is in its bridging position.

7. The method of installing a block and tackle type window sash balance as defined in any of claims 1 to 6 in a double-hung window unit in which the vertical sash members are ploughed, said method comprising starting with the sash in its bottom position in the sash track of the window frame or of a weatherstripping member, with the foot member of the sash balance retracted within the housing frame and with the lanyard extending outwardly from said frame; the end of the sash balance from which the lanyard extends is inserted into the ploughed channel sufficiently to enable the full length of the sash balance to be positioned in the upper portions of the sash track in alignment with the ploughed sash channel; securing the balance to the sash track; raising the sash to its upper position so that the balance extends into the ploughed sash channel and so that the lanyard extends below the bottom lower edge of the horizontal sash member; by means of the lanyard pulling the foot member from within the housing frame to a position below the bottom sash edge; repositioning the foot member so that it bridges the ploughed channel at the bottom edge of the horizontal sash and is maintained in the bridging position by the biasing action of the spring.

8. The method of installing a block and tackle type window sash balance as defined in any of claims 1 to 6 in a single or double-hung window unit in which the vertical sash members are ploughed, said method comprising starting with the sash in its uppermost position in the sash track of the window frame or of a weatherstripping member, with the foot member of the sash balance retracted within the housing frame and with the lanyard extending outwardly from said frame; the end of the sash balance opposite that from which the lanyard extends is inserted into the ploughed channel for the full length of the sash balance, lowering the sash and balance in the sash track, pushing or raising the sash balance from its position within the ploughed sash channel; raising the sash balance so that its upper end is in the desired position relative to the top of the sash track, securing the balance to the sash track; raising the sash to its upper position so that the balance extends into the ploughed sash channel and so that the lanyard extends below the bottom lower edge of the horizontal sash member; by means of the lanyard pulling the foot member from within the housing frame to a position below the bottom sash edge; repositioning the foot member so that it bridges the ploughed channel at the bottom edge of the horizontal sash and is maintained in the bridging position by the biasing action of the spring.

* * * * *